US007415931B2

(12) United States Patent
McConville et al.

(10) Patent No.: US 7,415,931 B2
(45) Date of Patent: Aug. 26, 2008

(54) METHODS AND APPARATUS FOR ACTIVE DEPLOYMENT OF A SAMARA WING

(75) Inventors: Richard P. McConville, Melrose, MA (US); James A. Hollowell, N. Andover, MA (US); Ralph L. Nardone, Billerica, MA (US); Norman C. Lariviere, N. Chelmsford, MA (US); Dean E. Rich, Londonderry, NH (US); Robert Kingsley, N. Andover, MA (US)

(73) Assignee: Textron Systems Corporation, Wilmington, MA (US)

( * ) Notice: Subject to any disclaimer, the term of this patent is extended or adjusted under 35 U.S.C. 154(b) by 392 days.

(21) Appl. No.: 11/185,149

(22) Filed: Jul. 20, 2005

(65) Prior Publication Data

US 2007/0017407 A1 Jan. 25, 2007

(51) Int. Cl.
*F42B 12/60* (2006.01)

(52) U.S. Cl. ..... 102/489; 102/388

(58) Field of Classification Search ..... 102/388, 102/489, 505; 244/3.24–3.3
See application file for complete search history.

(56) References Cited

U.S. PATENT DOCUMENTS 4,635,553 A 1/1987 Kane
4,756,253 A 7/1988 Herring et al.
4,829,903 A 5/1989 Axinger et al.
4,858,532 A 8/1989 Persson et al.
6,578,793 B2 * 6/2003 Byrnes et al. ..... 244/6
6,834,593 B2 * 12/2004 Nardone et al. ..... 102/489
7,163,176 B1 * 1/2007 Geswender et al. ..... 244/3.27
2001/0039898 A1 11/2001 Bar et al.
2003/0145757 A1 8/2003 Fischer et al.
2004/0011919 A1 1/2004 Johnsson et al.
2006/0232761 A1 * 10/2006 McConville et al. ..... 356/5.1

OTHER PUBLICATIONS

Dashcund, D., "IRAAM Wind Tunnel Test," Defense Information Systems Agency, Aug. 30, 1983, 64 pgs, Defense Technical Information Center, Ft. Belvoir, VA 22060-6218.

* cited by examiner

*Primary Examiner*—Troy Chambers
(74) *Attorney, Agent, or Firm*—BainwoodHuang

(57) ABSTRACT

Methods and apparatus are disclosed for the controllable deployment of a samara wing from a spinning housing by use of an active deployment system. The active deployment system operates to deploy the samara wing as a function of time, for example a step function, or a monotonic function. The samara wing may be attached to a base, which may include a releasable portion. The active deployment system may include an electronic control unit and release means. Suitable release means include, but are not limited to pin actuators, explosively actuated cutters, and the like. Suitable electronic control units include programmable electronic sequencers and the like.

18 Claims, 8 Drawing Sheets

METHODS AND APPARATUS FOR ACTIVE DEPLOYMENT OF A SAMARA WING

BACKGROUND

Certain classes of military munitions utilize the spinning motion of one or more air-deployed munitions to search within a target area for potential targets. After deployment at a height and relative position above and near the intended target(s), these munitions (also referred to as "submunitions") operate as "top attack" weapons to detect, attack, and destroy stationary or moving targets from above. Common targets for these types of submunitions include tanks and other armored fighting vehicles. Such submunitions include a housing for a warhead, optical sensors, and electronics for image processing. The warheads of these submunitions typically are explosively formed projectiles. When a target has been detected by the optical sensors and identified by optical recognition software included within the image processing electronics, the submunition warhead is fired at the target. Such submunitions are often called sensor-fuzed submunitions, because the firing sequence is initiated or "fuzed" by the included optical sensors.

These submunitions are commonly dispensed from a suitable airborne carrier vehicle or may be fired from artillery. Various aerodynamic systems may be included onboard these submunitions to attain desired flight dynamics after deployment from the carrier vehicle or artillery. These aerodynamic systems typically operate to control the deceleration, orientation, and stabilization of the submunition, and may also impart spinning and coning motions to the submunitions as they fall toward the target area. As a result of these imparted spinning and coning motions, each field of view (FOV) of the optical sensors scans the underlying target area in an inwardly tightening spiral as the submunition descends. This inwardly tightening spiral scan pattern allows the sensors to "search" for a desired target within a given target area.

During the decent of the submunitions, deceleration, orientation, and stabilization functions are key to enabling successful operation of the submunition. To achieve deceleration, a decelerator is typically deployed after the submunition is dispensed from the carrier vehicle or piece of artillery. The decelerator provides at least two functions. One function of the decelerator is to slow down the submunition from its initial velocity. Another function of the decelerator is to reposition the submunition to a near vertical orientation during descent at a terminal velocity. The decelerator may also function to displace the spin axis of the submunition with respect to its principal axis to generate the desired inwardly tightening spiral scan pattern that is used for target search and acquisition.

One type of submunition decelerator is a single-bladed flexible wing that is attached to a spinning submunition. Examples of such decelerators are described in U.S. Pat. No. 4,635,553 to Kane and U.S. Pat. No. 4,756,253 to Herring et al, both of which are owned by the assignee of the present application. These single-blade decelerators are sometimes referred to as "samara blades", or "samara wings", in reference to the similarity to certain winged seeds (samara is Latin for "seed of the elm").

FIG. 1 is a perspective view representing a simplified prior art spin-stabilized submunition 100 with a samara wing 102. The samara wing 102 is shown in stowed and deployed positions in FIG. 1A and FIG. 1B, respectively. The submunition 100 has a cylindrical housing 106 with a principal axis 108. The principal axis 108 is shown as substantially collinear with a spin axis 110 in FIG 1A and offset from an adjusted spin axis 110' in FIG. 1B. One end of the samara wing 102 is connected to a root location of a base 104 located at one end of the submunition 100. After its deployment from a carrier vehicle or piece of artillery and prior to the deployment of the samara wing 102, the submunition 100 spins about spin axis 110 with an initial angular velocity (Ω) 112. In the stored position, the samara wing 102 is held in place inside of the periphery 105 of the spinning submunition 100 at a radial distance 120 from the principal axis 108.

In FIG. 1B, the samara wing is shown in a deployed position useful for the deceleration, orientation, and stabilization of the submunition 100 while it is spinning in flight. When the samara wing 102 is deployed from a spinning submunition 100, the samara wing 102 is held taut by the centripetal force acting on a mass, or "tip weight," 102*b* that is located at one end of the samara wing 102 that is distal to the root location. As shown, the samara wing 102 has a desired width, or "chord" 102*c*, and a wingspan 102*d*. The main flight surfaces 102*a* of the samara wing 102 are positioned at a desired inclination angle, or angle of attack, to the relative wind stream as the submunition 100 spins in flight. When the samara wing 102 is deployed, the tip weight 102*b* has a tangential velocity, indicated by 114, that is related to the angular velocity (Ω') 112'.

With continued reference to FIG. 1B, the force that the tip weight 102*b* exerts back on the submunition 100 through its attachment point on the top of the submunition 100 close to the periphery causes the submunitions 100 to spin about the adjusted spin axis 110', which is shifted from the principal axis 108 of the submunition through an angle θ. This shifting of the of the spin axis 110' from the principal axis 108 produces the desired scanning motion in which the precession rate and the spin rate (Ω') 112' of the submunition 100 are equal to one another. Because the optical sensors (not shown) onboard the submunition are aligned along the principal axis 108, the matching of the precession rate and spin rate allows the submunition 100 and sensor FOV to maintain the same orientation with respect to the ground along the direction of the principal axis 108.

During flight of the submunition, the deployed samara wing 102 produces aerodynamic lift in a direction along the spin axis 110' of the submunition and opposite the direction of travel and thereby initially acts to decelerate the submunition 100. This deceleration acts through a center of drag that is displaced behind the center of gravity of the submunition 100. Consequently, as the submunition 100 loses its initial velocity, the acceleration of gravity causes the principal axis 108 to tip over toward a vertical orientation that is aligned with the flight path. Eventually, the acceleration due to gravity and the lift force become equal in magnitude and opposite in direction, causing the submunition 100 to achieve a terminal velocity. The samara wing 102 causes the submunition 100 to auto-rotate as it is pulled through the air and achieves a spin rate that results from the balance of the lift of the wing and its aerodynamic drag.

Samara wings have certain advantages over other types of decelerators. For example, the design parameters of a samara wing, e.g., wing span, chord, and tip weight mass, can be selected for different applications and conditions to yield a desired scanning pattern on the target area that leaves very little opportunity for the sensor trace, or scanned FOV, to miss any targets that may be present. Hence, the use of a samara wing in conjunction with a submunition can enable very effective lethality using simple optical sensors, e.g., those utilizing a small number of linear detector arrays. Further, samara wings may be used on any submunition that is dispensed or deployed at altitude and allowed to free-fall to earth. The submunitions can include mines or any variety of top attack smart submunitions.

While the operation of a samara wing can be simple and dependable once deployed, the requirements for the successful deployment of the samara wing 102 are not trivial and can be difficult to achieve. For example, if during the deployment of the samara wing, the tip weight 102*b* were to be simply released it would fly away with its initial tangential velocity. Absent an acceleration force to alter its angular velocity, the tip weight would fall behind and indeed wrap itself over the top of the submunition as the submunition spins, a condition that is known as wing-wrap.

Previous attempts have been made to address the problems of wing-wrap and variability of loading during deployment of a samara wing. Certain techniques utilize sacrificial rip stitching to releasably hold the samara wing in a folded, or "accordion-like" configuration. When the tip weight is released for deployment of the samara wing, the centripetal force developed at the tip weight pulls the rip stitching apart. Such techniques are passive in that they rely on the forces developed on the tip weight for the deployment of the samara wing. Because the flight dynamics and deployment conditions, e.g., atmospheric conditions, can vary drastically, passive deployment techniques have proven to be susceptible to a high degree of variability. Such passive techniques have been unreliable, with failed deployment of samara wing occurring in certain situations.

SUMMARY

Aspects of the present invention are directed to methods and apparatus that address the limitations described above for the prior art by employing an active deployment system, or means for active deployment, to controllably deploy a samara wing from a spinning housing such as those used for various top attack submunitions. The active deployment system functions to deploy the samara wing as a desired function of time, as opposed to prior art techniques that deploy a samara wing as a function of wing tension.

An embodiment includes a spin-stabilized submunition including a housing having a principal axis, a periphery, and, when in a spinning condition, a spin axis. A base is attached to one end of the housing. The housing may be cylindrical. A flexible samara wing has a tip weight attached to a first end and a second end that is attached to the base at a root location. The samara wing is operable to be deployed from a stowed position within a periphery of the housing to a deployed position. The samara wing has a wing chord and a wingspan. An active deployment system operates to deploy the samara wing as the housing is in the spinning condition. The active deployment system may include a control unit, and is operable to release the tip weight from a stowed position to a deployed condition as a desired function of time. The control unit may be a programmable electronic control unit.

The active deployment system may include a plurality of connections that connect the samara wing to the base, where each connection has a different length and is connected to the samara wing at a different location. The active deployment system may include release means that are operable to break the plurality of connections between the base and the samara wing. The electronic control unit may include a programmable electronic sequencer that is operable to initiate the release means in a desired manner as a function of time. The release means may include a plurality of explosively actuated cable cutters. Each explosively actuated cutter may include a cylinder having a longitudinal bore, an explosive contained within the longitudinal bore, a bridge wire operable to activate the explosive, a cable hole disposed through the cylinder, and a cutting element operable to slide within the longitudinal bore and sever a cable disposed through the cable hole in response to the activation of the explosive. The release means may include a plurality of pin actuators. Each pin actuator may include a piston operable to move within a bore from a first position to a second position, a lever operable to rotate from a first position to a second position about a pivot point in response to a force supplied by the piston moving from the first position to the second position, and a pin attached to a unique location on the wingspan of the samara wing. The lever, when in the first position holds the pin to the base, and the pin is released by the lever as the lever moves to the second position. The samara wing may be made of a flexible material, examples of which include, but are not limited to, nylon, aramid fibers, KEVLAR, polyethylene fibers, SPECTRA, or the like.

A further embodiment includes a method of deploying a samara wing. For the method, a housing having a principal axis is spun at an initial angular velocity. A tip weight of a first end of a flexible samara wing attached to the housing is released from a stowed position. The samara wing has a wingspan, and a second end of the samara wing is attached to the housing at a root location within the periphery of the housing. The tip weight is deployed position as a function of time, where the deployed position corresponds to the full extent of the wingspan of the samara wing. Tensile force is provided along the samara wing to the tip weight during deployment of the tip weight thereby providing angular acceleration to the tip weight so that the tip weight has an angular velocity equal to that of the housing. This allows the samara wing to be deployed without the samara wing wrapping around the spinning housing. A releasable portion of the base that has an active deployment system may be released after deployment of the samara wing to reduce the moment of inertia of the submunition about an axis orthogonal to the principal axis of the submunition.

The step of deploying the tip weight as a function of time may include deploying the tip weight as one or more step functions of time, e.g., in a stair-step manner. The step of deploying the tip weight as a function of time may include deploying the tip weight in four stages separated by equal time intervals. The step of deploying the tip weight may occur over 540 degrees of rotation of the spinning cylindrical housing. The step of deploying the tip weight as a function of time may include deploying the tip weight as a monotonic function of time.

Another embodiment includes a samara wing deployment module including a base for attachment to a housing. The deployment module further includes a samara wing having a wingspan, a chord, a first end with a tip weight attached thereto, and a second end attached to the base at a root location within the periphery of the housing. A plurality of cables may be included, each of which are attached at one end to the base at the root location and attached at a second end to the samara wing at a different location along the wingspan of the samara wing. Each cable forms a severable connection between the samara wing and the base. An active deployment system, or active deployment means, is attached to the base and is operable to deploy the samara wing as a function of time. The active deployment system or active deployment means may include release means for severing the connections formed by plurality of cables and an electronic control unit for controlling the activation of the release means.

The electronic control unit may include a programmable electronic unit or sequencer that is operable to actuate the release means. The release means may include a plurality of pin actuators. The release means may include a plurality of explosively actuated cable cutters. The plurality of cables may include a plurality of steel cables, a plurality of nylon fibers, a plurality of KEVLAR fibers, or the like. The base may include a fixed portion for attachment to a submunition and a releasable portion with a housing for the active deployment system or active deployment means, where the releasable portion is operable to be released from the fixed portion after the samara wing is deployed.

BRIEF DESCRIPTION OF THE DRAWINGS

These and other features, aspects, and advantages of the present invention will become better understood with regard to the following description, appended claims, and accompanying drawings. The drawings are not necessarily to scale, emphasis instead being placed upon illustrating the principles of the present invention. The drawings include the following:

DETAILED DESCRIPTION

The present invention may be understood by the following detailed description, which should be read in conjunction with the attached drawings. The following detailed description of certain embodiments is by way of example only and is not meant to limit the scope of the present invention.

Aspects of the present invention are directed to the deployment of a samara wing from a spinning housing, e.g., a spin-stabilized submunition or the like, by an active deployment system. The active deployment system functions to deploy the samara wing as a function of time, irrespective of the variable forces encountered during the deployment of the samara wing. The deployment of a samara wing by the active deployment system may be accomplished in stages, corresponding to a stepped function of time. Alternatively, the deployment may be continuous, corresponding to, for example, a monotonic function of time in some applications. Suitable submunitions that the present invention may be used with include, but are not limited to, the Skeet smart projectiles used in the CBU-105 of the U.S. Air Force. The active deployment system may include one or more suitable control units, which may be electronic control units or mechanical timing devices. As used herein, he term "active deployment system" may include reference to any suitable means for deploying a samara wing from a submunition according to a desired function of time.

Figure 1A:
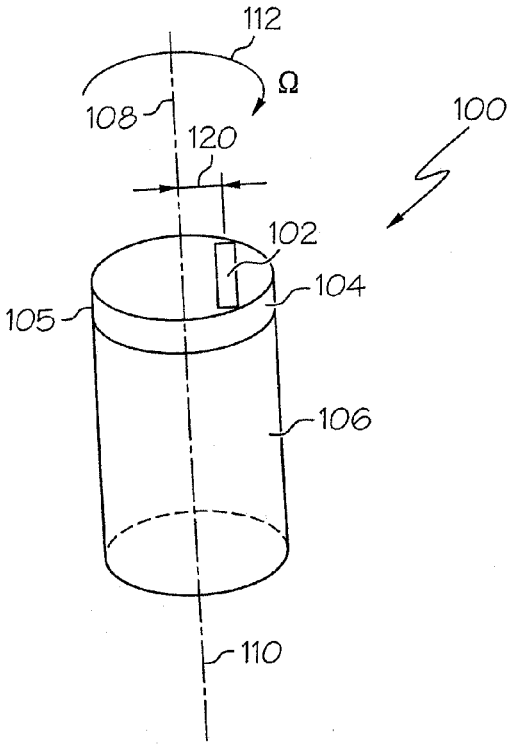
FIG. 1A (PRIOR ART)
FIG. 1 includes FIG. 1A and FIG. 1B, which are perspective views of a prior art spin-stabilized submunition with a samara wing in a stowed position and deployed position, respectively.
Figure 1B:
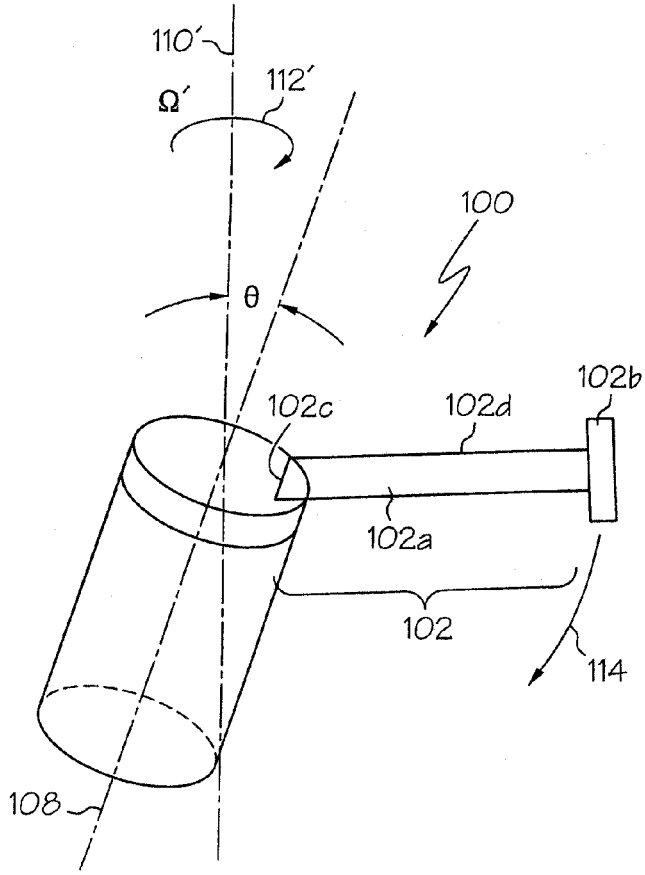
FIG. 1B (PRIOR ART)
Figure 2:
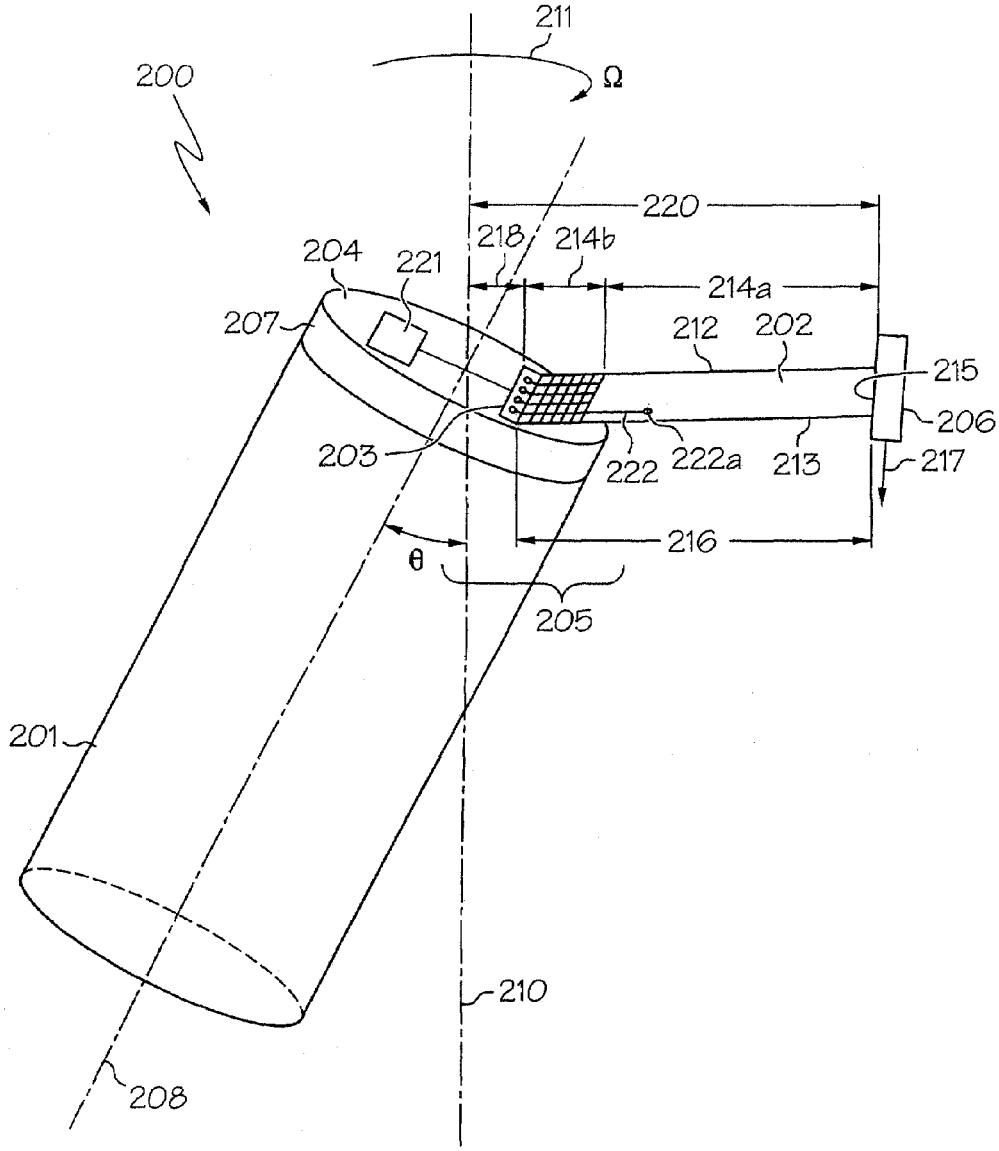
FIG. 2 is a perspective view of a spin-stabilized submunition including an active deployment system and a samara wing depicted in a partially deployed position, in accordance with an embodiment of the present invention.

FIG. 2 is a perspective view depicting main components of a spin-stabilized submunition 200 including a samara wing 202 and active deployment system 205, in accordance with an embodiment of the present invention. The spinning motion of the submunition 200 may be imparted by any suitable means, e.g., a spin motor located within the submunition 200, a catapult on an associated carrier vehicle, a lever arm, or the like. The samara wing 202 is depicted in a partially deployed position with a taut portion 214*a* and a folded or collapsed portion 214*b*. The submunition 200 includes a cylindrical housing 201 that has a longitudinal, or principal axis 208. A base 204 is attached to one end of the housing 201. The base 204 serves as an attachment structure for the active deployment system 205. The samara wing 202 has one end that is attached to the housing 204 at a root location 203. A tip mass, or "tip weight" 206, is attached to the samara wing 202 at the end opposite the root location 203. The samara wing 202 has a wingspan 216, a width or "chord" 215, and leading and trailing edges 212-213. The root location 203 is located inboard of a periphery 207 of the base 204, and when the samara wing is deployed is located at a radial distance 218 from a spin axis 210. While not depicted in the drawings, it will be understood that for this embodiment and others described herein, optical sensors are attached to the submunition such that the field of view (FOV) of each of the sensors is substantially orthogonal to the principal axis 208 of the submunition 200.

With continued reference to FIG. 2, the active deployment system 205 may include an electronic control unit 221 and release means, e.g., cable cutters (not shown) and a number of cables 222. The electronic control unit 221 may be a programmable unit that stores a time-based deployment command signal or profile from a carrier vehicle or other transmission location. Transmission and reception of such signals may be by any suitable communications link, e.g., a wireless link, a RS-232 link, a RS-422 link, a MIL-STD 1760 link, etc. Each of the cables 222 is connected to the root location 203 and a desired location 222*a* along the wingspan of the samara wing 202. Suitable apparatus for the release means include, but are not limited to systems such as the following: governors that pay out a single continuous cord, cable, or wire during the steady deployment of the tip weight; clockwork mechanisms that limit the speed that successive releases may take place; pin actuators; explosively-actuated cable cutters; and the like. The electronic control unit 221 is operable to activate the release of the various connected cables 222. For example, in some embodiments by supplying or controlling a suitable voltage and/or current to the release means, the electronic control unit 221 may effect the deployment of the samara wing 202 as a desired function of time.

In operation, prior to deployment of the samara wing 202, the tip weight 206 is stored on top of the submunition 200 in a location that is inboard of the periphery 207 of the submunition 200. Because of this positioning, the tip weight 206 has an initial tangential velocity that is equal to its initial radial distance 218 from the spin axis 210 of the submunition 200 times the angular velocity Ω 211 of the spinning submunition 200, i.e., prior to the deployment of the samara wing 202. When the submunition 200 is spinning, the tip weight has a tangential velocity 217 that is related to the angular velocity 211, the initial radial distance 218, and the wingspan 216. During deployment of the samara wing 202, the angular momentum of the submunition is preserved and therefore the submunitions 200 spin rate slows down to Ω', which is less than the initial angular velocity Ω. As the active deployment system 205 deploys the tip weight 206, the spin axis 210 and the principal axis 208 become non-parallel, as shown in FIG. 2, and the radial distance from the tip weight to the spin axis 210 increases.

To prevent wing-wrap from occurring during the deployment of the samara wing 202, the active deployment system 205 operates to accelerate the tip weight 206 during the transit of the samara wing 202 from its stowed location to its deployed position. As the samara wing 202 is deployed a tensile force acts upon the tip weight 206 via the connections 222, e.g., cords or cables, and a portion of the samara wing 202. As the samara wing 202 is released incrementally, acceleration is provided to the tip weight 206 by way of one or more connections between the root location 203 and portions of the samara wing 202 via cables or cords. By releasing the samara wing 202 incrementally, the tangential velocity 217 of the tip weight 206 is increased during each incremental deployment. Thus, the angular velocity of the tip weight 206 is caused to be sufficiently close to the angular velocity 211 of the submunition during deployment of the samara wing 202 and wing wrap is prevented.

The samara wing 202 may be made of any suitable flexible material. The flexible material may be woven fabric in certain applications. Examples of materials that are suitable for a samara wing 202 include but are not limited to plastic, nylon, aramid, KEVLAR aramid cloth, SPECTRA polyethylene cloth, or the like. (KEVLAR is a registered trademark of E.I. du Pont de Nemours and Company, of 1007 Market Street, Wilmington, Del. 19898. SPECTRA is a registered trademark of Honeywell International Inc. of 101 Columbia Road, Morristown, N.J. 07962.)

Figure 3:
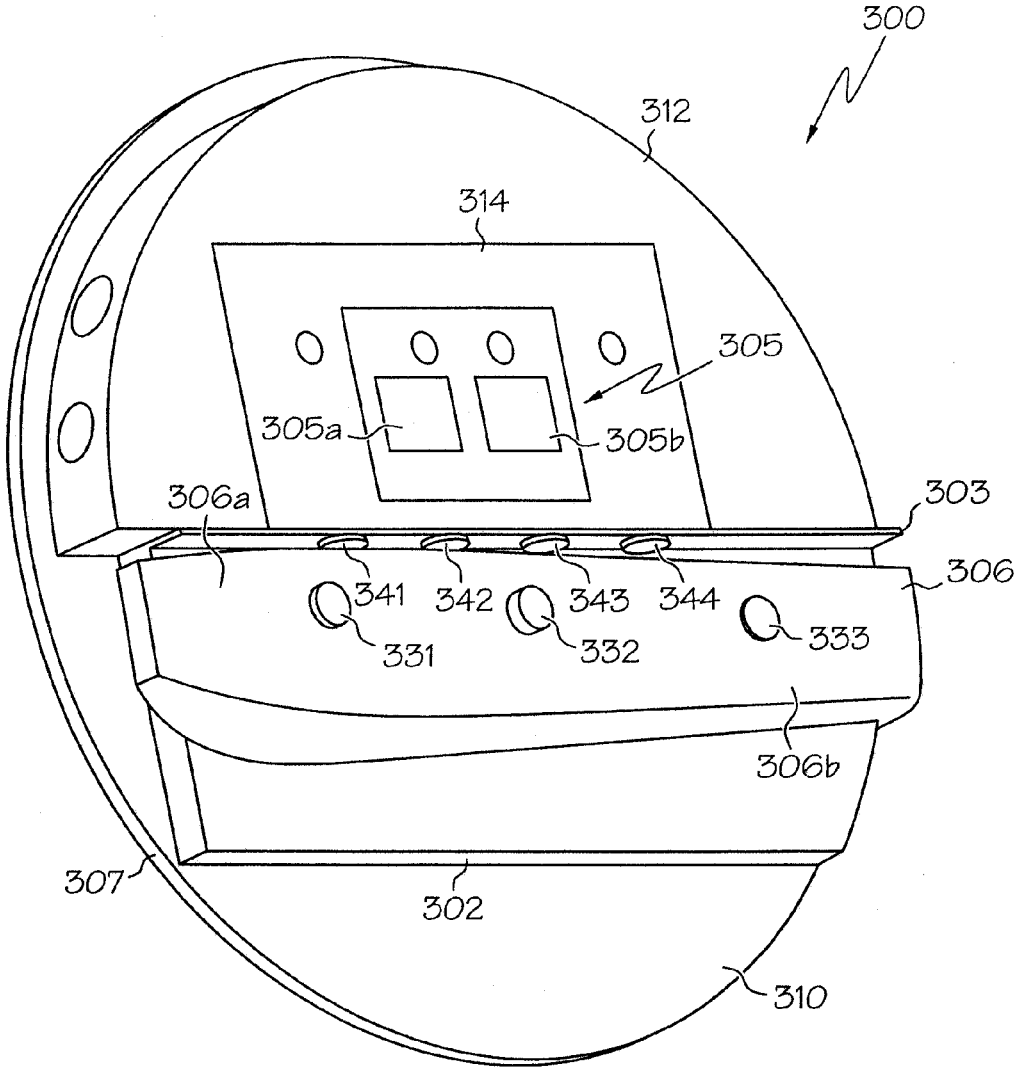
FIG. 3 is a perspective view of a deployment module and a samara wing for use on a spin-stabilized submunition, in accordance with an embodiment of the present invention.

FIG. 3 is a perspective view of a deployment module 300 including a samara wing 302 and active deployment system 305, in accordance with another embodiment of the present invention. The samara wing 302 is connected at one end to a root location 303 on the base 310 and at the other end to a tip weight 306. The base 310 is of a kind suitable for attachment to a spin-stabilized submunition. The active deployment system 305 is located within a housing 312 attached to the base 310. The tip weight 306 may be attached to the samara wing 302 by suitable means, e.g., pin attachments 331-333, as shown, or a rod-and-sleeve configuration, or other suitable connection means. In certain applications, the tip weight 306 may be held within a pocket (not shown) that is formed at or attached to one end of the samara wing 302. It may be desirable in some applications for a protective cover 314 to be positioned over the active deployment system 305, as indicated. The samara wing 302 is depicted in folded or stowed position inboard of the periphery 307 of the base 310.

The tip weight 306 includes a fore portion **306*a* and an aft portion 306*b* that may each have a desired mass distribution and shape. The mass distribution and shape of the fore 306*a* and aft 306*b* portions may be selected to reduce aerodynamic drag and to position the center of gravity of the tip weight 306 with respect to its center of pressure (or center of buoyancy) so as to facilitate a desired angle of attack for the samara wing 302** when deployed.

With continued reference to FIG. 3, the active deployment system 305 includes an electronic control unit **305*a* and active release means 305*b* that may include, for example, pin actuators, explosively-actuated cable cutters, or other electromechanical actuators, that are capable of releasing the tip weight 306 according to a desired function of time. The active deployment system 305 is operable to control the active release means as a function of time. In the embodiment depicted in FIG. 3, the active release means is operable to release pin connections 341-344 that are each releasably attached to the samara wing 302 at successive locations along its wingspan. As a result, the active deployment system 305 operates to controllably deploy the samara wing 302 according to a desired function of time, regardless of any variations in the attendant forces on the samara wing 302** as the associated submunition is in flight.

A suitable power source may be used for the active deployment system 305. In certain applications, the power source may be a thermal battery (not shown) that may be present within the housing 312 or on the base 310 to provide the power to operate the active deployment system 305. Thermal batteries are commonly used in military applications, and usually operate at high temperatures (e.g., 400-600° C.) to generate relatively large amounts of power for the size of the battery. The high temperature is reached using internal pyrotechnic heat sources. Suitable thermal batteries may include those utilizing a lithium/lithium halide/iron sulphide electrolyte system. A suitable thermal battery is available from Eagle Picher, Inc. under part number EAP12083. Other suitable batteries may of course be used.

Figure 4:
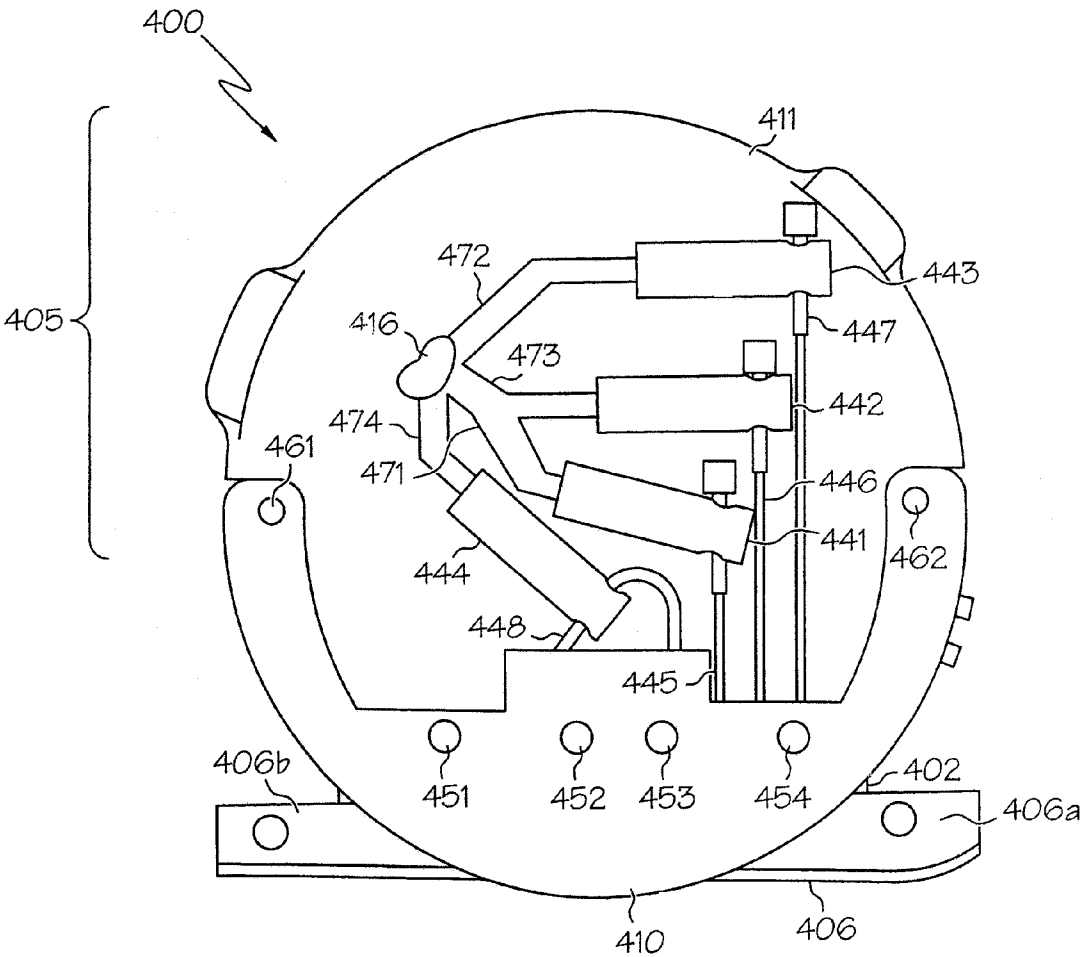
FIG. 4 is a bottom view of a deployment module that includes a releasable base portion, in accordance with a further embodiment of the present invention.

FIG. 4 is a bottom view depicting a further embodiment 400 in which active deployment system 405 is connected to a releasable base portion. A samara wing 402 is connected at one end to a root location of a base 410, as indicated by the line of pin attachments 451-454. The base 410 is configured for attachment to a spin-stabilized submunition. The base 410 includes a removable portion 411. The removable portion 411 is detachably connected to the base 410 by suitable connections such as snap-fit arrangements, tongue-and-groove arrangements, or the like. A cable 448 secures the releasable portion 411 to the base 410 until after deployment of the samara wing 402. Alignment posts 461-462 may facilitate positioning of the releasable portion 411 with respect to the base 410. Similar to embodiments described previously, a tip weight 406 having fore **406*a* and aft 406*b* portions is connected the end of the samara wing 402** that is distal to the root location.

For some applications, the active deployment system 405 may include an electronic control unit (not shown) and a plurality of active release means such as cable cutters 441-444, which are configured within the housing 412. The electronic control unit 405 is operable control the activation of the cable cutters 441-444. For example, the electronic control means 405 may direct sufficient current, e.g., 0.5-2 Amps, from an associated power source, e.g., a thermal battery, to the cables cutters 441-444 by way of electrical connections 471-474 routed through passage 416. The plurality of cable cutters 441-444 function to cut associated cords or cables 445-448 at desired times after the launch of the associated submunition. As in the previously described embodiments, the cables 445-447 are attached to points at different distances along the wingspan of the samara wing 402. Cable 448 may secure the removable portion 411 to the base 410, as described previously.

Suitable explosively-actuated cable cutters may include a cylinder having a longitudinal bore, an explosive contained within the longitudinal bore, a bridge wire operable to activate the explosive, a cable hole disposed through the cylinder, and a cutting element operable to slide within the longitudinal bore and sever a cable disposed through the cable hole in response to the activation of the explosive. Examples of suitable cable cutters include, but are not limited to, cable cutters Part No. 301204 and Part No. 303110 made available by Cartridge Actuators, Inc. of 51 Dwight Place, Fairfield, N.J. 07004.

In operation, the controlled and sequential cutting of the cables 445-447 incrementally deploys the samara wing 406 according to a desired function of time, regardless of variable loading and flight conditions that are encountered. After the samara wing 406 is deployed, the removable portion 411 may be jettisoned from the submunition by the severing of cable 448 by the associated cable cutter 444. When released, the removable portion 411 separates from the associated submunition, effectively reducing the moment of inertia of the submunition about an axis orthogonal to the principal axis of the submunition. This lessens the tendency of the spinning submunition to rotate about such an axis. Release of the removable portion 411 may be desirable in certain applications to reduce the amount of mass that is spaced apart from the center of gravity of the spinning submunition to thereby improve the spin dynamics of the submunition.

Figure 5:
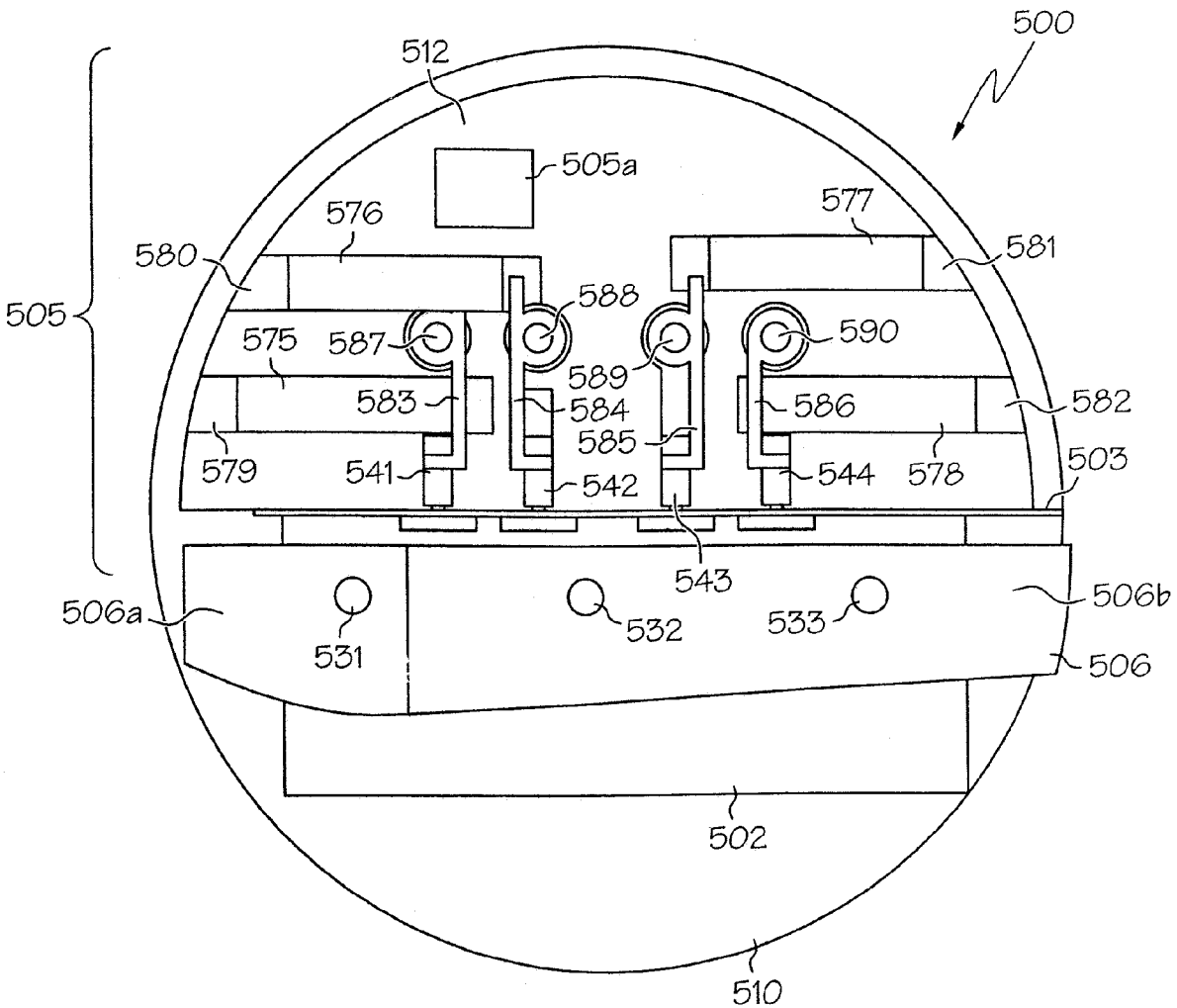
FIG. 5 is a top view of a deployment module with detail of an active deployment system, in accordance with a further embodiment of the present invention.

FIG. 5 is a top view of a deployment module 500 in which pin actuators are utilized for release means for the active deployment system 505, in accordance with a further embodiment of the present invention. The active deployment system 505 includes an electronic control unit 505*a*, and is operable to incrementally deploy the samara wing 502 as a desired function of time. The active deployment system 505 controls the deployment of a flexible samara wing 502 that is suitable for use as a decelerator on a spin-stabilized submunition. The samara wing 502 is connected at one end to a base 510 that is suitable for mounting to a submunition. A tip weight 506 is attached to the other end of the samara wing 502 by suitable means such as rivets 531-533. The tip weight includes fore and aft portions, respectively, 506*a* and 506*b*. The base 510 is configured to receive one end of the samara wing 502 along an attachment line, or root location 503. The active deployment system 505 is located within a housing 512 attached to the base 510.

The active release means may include a plurality of pin actuators or other suitable devices. The pin actuators may each include a piston 575-578, respectively, that is operable to move within a bore 579-582, respectively, in the housing 512. Each piston 575-578 operates to rotate a lever arm 583-586, respectively, about a pivot point 587-590, respectively. The end of each lever arm 583-586 that is distal to the associated piston 575-578 is configured to secure a pin 541-544 to the root location 503 when that lever arm 583-586 is in a particular orientation. Examples of suitable pin actuators include, but are not limited to, pin actuators Part No. 42340-1 and Part No. 42340-3, made available by Networks Electronic Corp., of 9740 Desoto Ave., Chatsworth, Calif. 91311.

In operation, the electronic control unit 505*a* controls the sequential activation of the pistons 575-578. Movement of each piston, e.g., 575, releases the associated pin, e.g., 541, from the root location 503 on the base 501. The successive release of the pins 541-544 incrementally releases the samara wing 502 from the submunition in stages according to a desired time sequence. For example, at desired times after the release of the submunition from its carrier vehicle, the electronic control unit 505*a* may direct sufficient current, e.g., 0.5-2 A, from an associated power source, e.g., a thermal battery, to the pin actuators. Sufficient current may be supplied by way of electrical connections 571-574 routed through passage 516.

Figure 6:
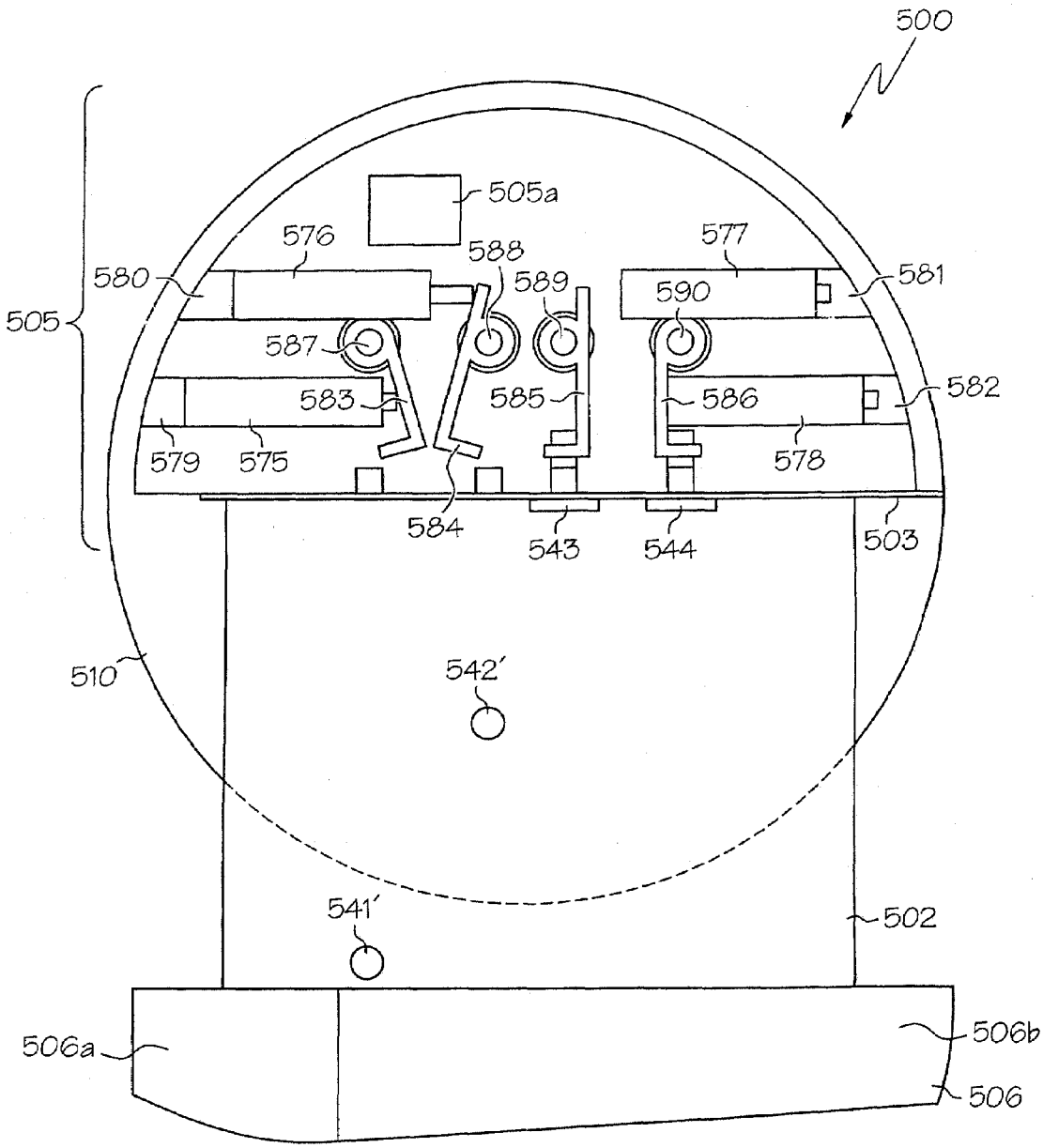
FIG. 6 is a top view of the deployment module of FIG. 5, depicting the samara wing in a partially deployed condition.

FIG. 6 is a top view of the deployment module of FIG. 5, depicting the samara wing 502 in a partially deployed condition. Two pistons 575-576 of the release means are depicted in extended positions, relative to their positions in FIG. 5. The associated lever arms 583-584 are consequently depicted as being rotated about their respective pivot point 587-588, which movement has released the associated pins 541-542 (of FIG. 5). The remaining two pistons 577-578 are in the retracted positions shown in FIG. 5. Lever arms 585-586 continue to hold the related pins 543-544 against the root location 503.

For the deployment of the samara wing 502, the active deployment system 505 releases the pins 541-544 (of FIG. 5) sequentially according to a desired function of time, e.g., a programmed sequence. For this process, the pin 541 (of FIG. 5) that secures the samara wing 502 to the root location 503 is released first. This allows the samara wing 502 and the tip weight 506 to be deployed a distance equal to that between the tip weight 506 and the corresponding attachment location 541' for that pin 541, which is located inward radially from the tip weight 506. This wing attachment location is indicated by position 541' on the wingspan in FIG. 6. Next in the deployment process, a second pin, indicated by position 542', is released, causing the samara wing 502 and the tip weight 506 to be deployed an additional incremental distance, i.e., up to the point that pin 543 holds the samara wing 502 to the root location 503 in FIG. 6. The deployment process may be repeated until the samara wing 502 and the tip weight 506 are fully deployed. In certain embodiments, for a submunition having a spin rate of 30 Hz and a samara wing having a wingspan of ten (10) inches, the samara wing 502 may be incrementally released in four stages, with equal time intervals, e.g., 0.025 seconds, occurring between successive stages. For other applications, the samara wing 502 may be released continuously, or in stages with a relatively long time interval between the initial stage of deployment and subsequent stages in order to tailor the flight trajectory of the submunition as desired.

Figure 7:
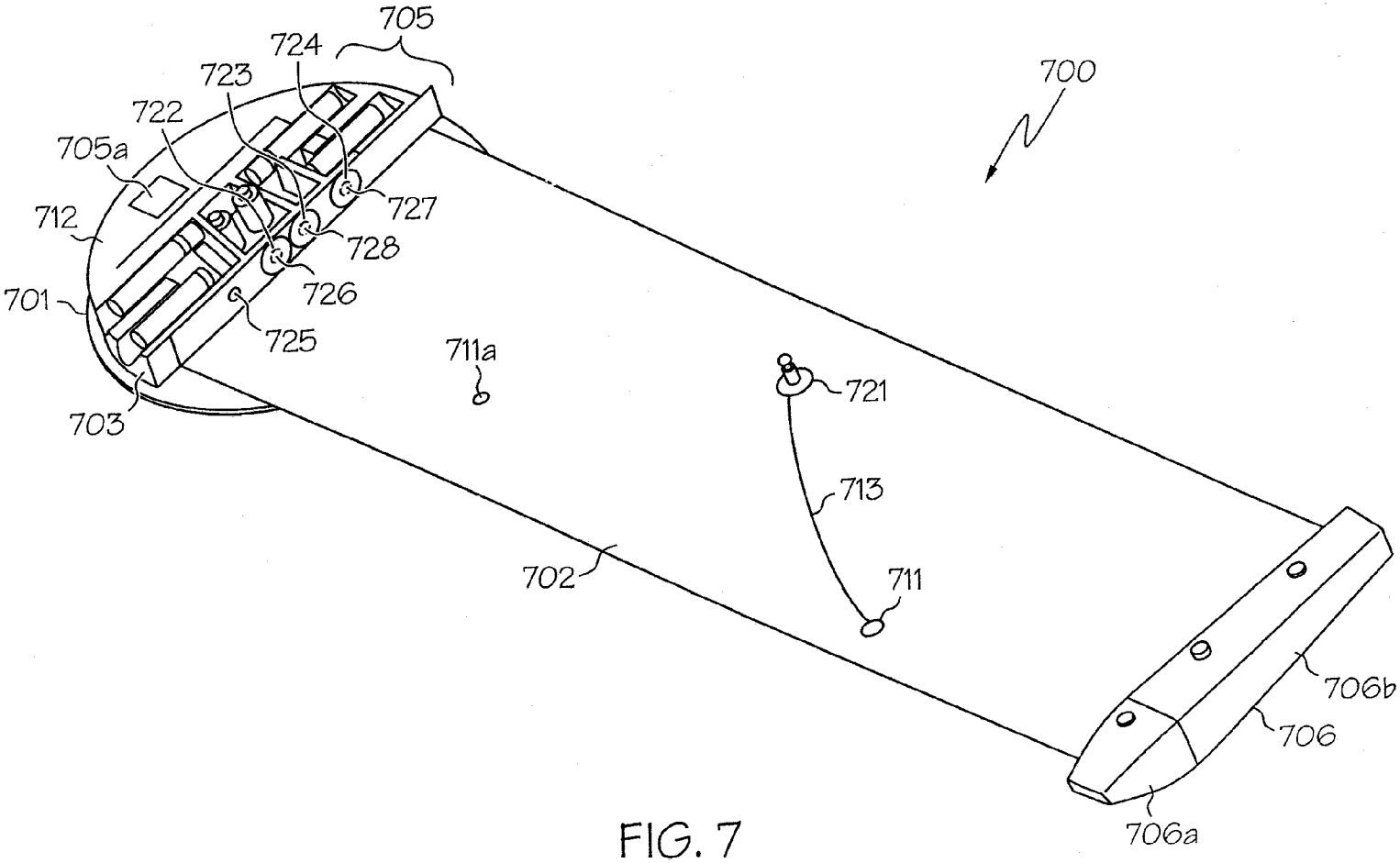
FIG. 7 is a perspective view of a deployment module with a deployed samara wing and alternate pin-wing attachment configurations, in accordance with an embodiment of the present invention.

FIG. 7 is a perspective view of a deployment module 700 including a samara wing 702 and active deployment system 705, in accordance with a further embodiment. The samara wing 702 is depicted in a fully deployed condition. During flight of an associated spinning submunition, with the samara wing 702 fully deployed, the samara wing 702 is held taught by the centripetal force acting on a tip weight 706. The samara wing 702 is affixed to a root location, e.g., a mounting plate, 703 that is connected to the base 701. The tip weight 706 has fore 706*a* and aft 706*b* portions, and is connected to the end of the samara wing 702 that is distal to the root location 703. The base 701 is configured for attachment to an associated housing, e.g., that of a submunition (not shown). The active deployment system 705 is configured within a housing 712 attached to the base 701. The active deployment system 705 may include an electronic control unit 705*a* and active release means that operates to physically release connections, e.g., releasable pins 721-724, between the samara wing 702 and the base 701. Suitable release means may include, but are not limited to, a plurality of pin actuators, electromechanical cable cutters, explosively-actuated links, or the like. The electronic control unit 705*a* may include suitable programmable timing functionality or devices such as electronic counters, timers, delays, microcontrollers, or the like. For certain applications, a suitable electronic controls unit 705*a* may include a programmable electronic sequencer. The active deployment system 705 operates to release the releasable pins 721-724, and hence the samara wing 702, incrementally according to a desired release sequence, similar to that described previously for FIGS. 5-6.

Each of the pins 721-724 of FIG. 7 is attached to the samara wing 702 at a different location along the wingspan of the samara wing 702. A portion, e.g., a shaft, of each of the pins

721-724 may protrude through a corresponding hole 725-728 at the root location 703, and may be held by a corresponding pin actuator of the active deployment means 705. A portion of each pin may be secured to the samara wing 702 at a desired location along the wingspan of the samara wing 702. A pin may be releasably attached or affixed to a desired location of the samara wing 702 by suitable means as indicated by alternate attachment locations 711 and 711*a*. For example, a pin may be connected to a cord or cable 713 of sufficiently strong material, e.g., KEVLAR, which is attached to a desired location of the samara wing 702. In certain applications, a pin may have a base portion that is attached directly to a desired location of the samara wing 702 for example by a reinforced pocket (not shown) within the samara wing 702. In certain applications, a desired location of the samara wing may be held to the root location 703 by a pin that is inserted through a hole or aperture 711*a* in the samara wing 702. For such applications, a pin actuator may releasably hold a shaft of the pin that is inserted through a hole located at the root location 703. A pin flange or annular pin base portion may serve to hold the desired location of the samara wing 702 to the base at the root location 703.

Figure 8:
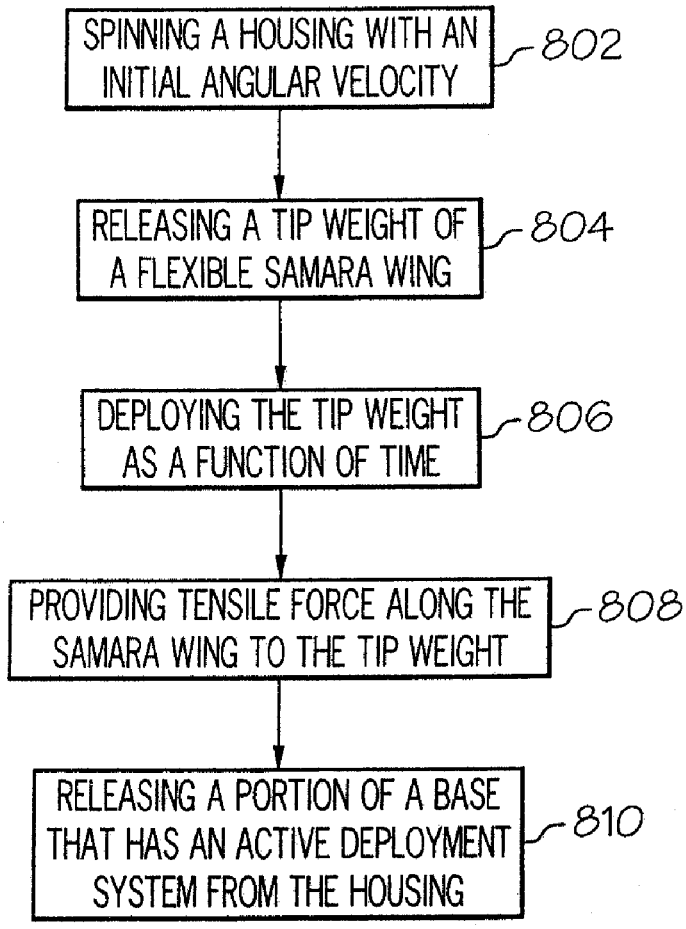
FIG. 8 is a block diagram that describes steps in a method of deploying a samara wing, in accordance with another embodiment of the present invention.

FIG. 8 depicts steps in a method of deploying a samara wing according to an embodiment of the present invention. A housing, which may be of a desired shape, e.g., cylindrical, is spun at an initial angular velocity, as described at step 802. The spinning motion may be imparted by any suitable means, e.g., a spin motor located within a submunition, a catapult, lever arm, or the like. A tip weight of a first end of a flexible samara wing attached to the housing is released from a stowed position, as described at step 804. The samara wing has a wingspan and a second end of the samara wing is attached to the housing at a root location within the periphery of the housing.

Continuing with the description of method 800, the tip weight is deployed to a deployed position according to a desired, e.g., preprogrammed, a function of time, as described at step 806. The deployed position corresponds to the full extent of the wingspan of the samara wing. Tensile force is provided to the weight tip, e.g., via a cable or portion of the samara wing, during deployment of the tip weight, as described at step 808. This tensile force provides sufficient angular acceleration to the tip weight so that wing-wrap is avoided, i.e., so that the tip weight has an angular velocity equal to that of the housing and the samara wing is deployed without the samara wing wrapping around the spinning housing. Once the samara wing is deployed, a portion of the base that includes active deployment means may be jettisoned or released, as described at step 810.

In one embodiment, the step of deploying the tip weight as a function of time may include deploying the tip weight in four stages, each separated by equal time intervals, e.g., 0.025 seconds, over a desired range, e.g., 540 degrees, of rotation of the spinning housing. For other applications, the step of deploying the tip weight may include a relatively long time interval between the initial stage of deployment and subsequent stages in order to tailor the flight trajectory of the submunition as desired. A greater or lesser number of stages may be utilized for the deployment of a samara wing in other embodiments.

Accordingly, embodiments of the present invention offer advantages over the prior art. For example, embodiments of the present invention may be used to reliably deploy a samara wing on a spinning housing, e.g., a spin-stabilized submunition, under a wide variety of operational conditions. Because active deployment of a samara wing is accomplished as a function of time, irrespective of tensile forces in the samara wing, consistent deployment is achieved. Suitable submunitions that the present invention may be used with include, but are not limited to, the Skeet smart projectile used in the CBU-105 of the U.S. Air Force. After deployment of a samara wing, the spin dynamics of the associated submunition may be improved by releasing or jettisoning a releasable portion of the base that includes active deployment system.

Although certain embodiments of the present invention have been described, other versions are possible. For example, various other methods and apparatus for supplying an accelerating force to a tip weight by the application of tension through a samara wing are within the scope of the present invention. In some embodiments, stiffness may be provided to the samara wing by adding structure that erects as the wing is deployed. Other methods and apparatus may include stiff elements that unfold and lock into place as the samara wing deploys or two-dimensional tapes that provide lateral stiffness as they unroll. Other methods and apparatus may include such devices as governors that pay out a single continuous cord, cable, or wire during the steady deployment of the tip weight and samara wing or clockwork mechanisms that limit the speed that successive releases may take place. Any number of stages may be employed for embodiments utilizing staged deployment of a samara wing. Further, while samara wings have been described herein as generally having constant chords, this is not a requirement and the chords may vary along the wingspan of a samara wing in certain embodiments. Moreover, while active deployment means have been generally described for certain embodiments as including electronic control means for control of the deployment of a samara wing, mechanical timers, mechanical fuzes, or the like may be used as control means in certain embodiments.

While the present invention has been particularly shown and described with references to certain embodiments thereof, it will be understood by those skilled in the art that various changes in form and details may be made therein without departing from the spirit and scope of the invention as defined by the appended claims.

What is claimed is:

1. A spin-stabilized submunition comprising:

a housing having a principal axis, a periphery, and, when in a spinning condition, a spin axis;

a base attached to one end of the housing;

a samara wing having a tip weight attached to a first end and a second end attached to the base at a root location, wherein the samara wing is operable to be deployed from a stowed position within a periphery of the housing to a deployed position when the housing is in the spinning condition, wherein the samara wing has a wing chord and a wingspan; and an active deployment system for deploying the samara wing from a stowed position to a deployed condition as a function of time.

2. The submunition of claim 1, wherein the active deployment system comprises:

a plurality of connections that connect the samara wing to the base, wherein each connection has a different length and is connected to the samara wing at a different location; and release means that are operable to break the plurality of connections between the base and the samara wing.

3. The submunition of claim 2, wherein the active deployment system includes a control unit that is operable to release the plurality of connections as a function of time.

4. The submunition of claim 3, wherein the control unit comprises a programmable electronic sequencer that is operable to initiate the release means in a desired manner as a function of time.

5. The submunition of claim 2, wherein the release means comprise a plurality of explosively actuated cutters, wherein each of the plurality of explosively actuated cutters is operable to release one of the plurality of connections.

6. The submunition of claim 5, wherein each of the plurality of explosively actuated cutter includes a cylinder having a longitudinal bore, an explosive contained within the longitudinal bore, a bridge wire operable to activate the explosive, a cable hole disposed through the cylinder, and a cutting element operable to slide within the longitudinal bore and sever a cable disposed through the cable hole in response to the activation of the explosive.

7. The submunition of claim 2, wherein the release means comprise a plurality of pin actuators, wherein each of the plurality of pin actuators is operable to release one of the plurality of connections.

8. The submunition of claim 7, wherein each pin actuator comprises:

a piston operable to move within a bore from a first position to a second position;

a lever operable to rotate from a first position to a second position about a pivot point in response to a force supplied by the piston moving from the first position to the second position; and a pin attached to a unique location on the wingspan of the samara wing, wherein the pin is held by the lever when the lever is in the first position, and wherein the pin is released by the lever as the lever moves to the second position.

9. A method of deploying a samara wing, said method comprising the steps of:

spinning a housing having a principal axis at an initial angular velocity;

releasing a tip weight of a first end of a flexible samara wing attached to the housing from a stowed position, wherein the samara wing has a wingspan and wherein a second end of the samara wing is attached to the housing at a root location within the periphery of the housing;

deploying the tip weight to a deployed position as a function of time;

providing tensile force along the samara wing to the tip weight during deployment of the tip weight thereby providing angular acceleration to the tip weight during deployment so that the tip weight has an angular velocity equal to that of the housing;

preventing the samara wing from wrapping around the spinning cylindrical housing during the step of deploying the tip weight; and releasing a portion of the base that has an active deployment system, thereby reducing the moment of inertia of the submunition about an axis orthogonal to the principal axis of the submunition.

10. The method of claim 9, wherein the step of deploying the tip weight as a function of time includes deploying the tip weight as one or more step functions of time.

11. The method of claim 10, wherein the step of deploying the tip weight as a function of time includes deploying the tip weight in four stages separated by equal time intervals.

12. The method of claim 11, wherein the step of deploying the tip weight occurs over 540 degrees of rotation of the spinning housing.

13. The method of claim 9, wherein the step of deploying the tip weight as a function of time includes deploying the tip weight as a monotonic function of time.

14. A samara wing deployment module comprising:

a base for attachment to a housing;

a samara wing having a wingspan, a chord, a first end with a tip weight attached thereto, and a second end attached to the base at a root location within the periphery of the cylindrical housing;

a plurality of cables, each attached at one end to the base at the root location and attached at a second end to the samara wing at a different location along the wingspan of the samara wing, wherein each cable forms a severable connection between the samara wing and the base; and an active deployment system for deploying the samara wing as a function of time, the active deployment system including release means for severing the connections formed by plurality of cables and an electronic control unit for controlling the activation of the release means, and wherein the active deployment system is attached to the base.

15. The module of claim 14, wherein the electronic control unit includes a programmable electronic sequencer operable to actuate the release means.

16. The module of claim 14, wherein the release means include a plurality of pin actuators, wherein each of the plurality of pin actuators is operable to release one of the plurality of cables.

17. The module of claim 14, wherein the release means include a plurality of explosively actuated cable cutters, wherein each of the plurality of explosively actuated cutters is operable to release one of the plurality of cables.

18. The module of claim 14, wherein the base includes a fixed portion for attachment to a submunition and a releasable portion with a housing for the active deployment system, wherein the releasable portion is operable to release from the fixed portion after the samara wing is deployed.

* * * * *